US011834209B2

(12) United States Patent
Ponti

(10) Patent No.: US 11,834,209 B2
(45) Date of Patent: Dec. 5, 2023

(54) METHOD FOR REALISING A CARDBOARD BLANK FROM A CARDBOARD FOR PACKAGING AND FOR BOXING AT LEAST AN ARTICLE WITH THE CARDBOARD BLANK

(71) Applicant: C.M.C. S.p.A., Cerbara-Citta' di Castello (IT)

(72) Inventor: Giuseppe Ponti, Cerbara-Citta' di Castello (IT)

(73) Assignee: C.M.C. S.P.A., Cerbara-Citta'di (IT)

( * ) Notice: Subject to any disclaimer, the term of this patent is extended or adjusted under 35 U.S.C. 154(b) by 357 days.

(21) Appl. No.: 17/426,983

(22) PCT Filed: Feb. 10, 2020

(86) PCT No.: PCT/IB2020/051010

§ 371 (c)(1),
(2) Date: Jul. 29, 2021

(87) PCT Pub. No.: WO2020/165723

PCT Pub. Date: Aug. 20, 2020

(65) Prior Publication Data

US 2022/0119138 A1 Apr. 21, 2022

(30) Foreign Application Priority Data

Feb. 11, 2019 (IT) ..... 102019000001889

(51) Int. Cl.
*B65B 43/10* (2006.01)
*B65B 11/00* (2006.01)
(Continued)

(52) U.S. Cl.
CPC ..... *B65B 11/004* (2013.01); *B65B 43/10* (2013.01); *B65B 61/005* (2013.01); *B65D 5/2076* (2013.01); *B65D 5/443* (2013.01)

(58) Field of Classification Search
USPC ..... 53/456
See application file for complete search history.

(56) References Cited

U.S. PATENT DOCUMENTS

2007/0257094 A1* 11/2007 Jackson ..... B65B 13/02 229/199
2015/0224731 A1* 8/2015 Ponti ..... B65D 5/2095 493/59
2019/0300210 A1* 10/2019 Ponti ..... B65B 5/024

FOREIGN PATENT DOCUMENTS

JP H1149137 A 2/1999
JP 2000177781 A 6/2000
(Continued)

*Primary Examiner* — Chinyere J Rushing-Tucker
(74) *Attorney, Agent, or Firm* — R. Neil Sudol; Henry D. Coleman

(57) ABSTRACT

Forming a cardboard blank includes making two score lines on a cardboard sheet to define a central sector with three portions and two lateral sectors. Four cuts are made in a direction transverse to the score lines to form in one lateral sector a first closing flap and first and second reinforcing flaps and, in the other lateral sector, a second closing flap and third and fourth reinforcing flaps. The first and second closing flaps are folded at respective score lines, and one portion folded to cover a flank of an article on another portion so the first and third reinforcing flaps project. A third portion is folded to cover another flank and an upper article face so the second and fourth reinforcing flaps project. A band folds the first two reinforcing flaps towards the first closing flap and the third and fourth reinforcing flaps towards the second closing flap.

7 Claims, 10 Drawing Sheets

(51) Int. Cl.

| | |
|---|---|
| ***B65B 61/00*** | (2006.01) |
| ***B65D 5/20*** | (2006.01) |
| ***B65D 5/44*** | (2006.01) |

(56) References Cited

FOREIGN PATENT DOCUMENTS

| | | | |
|---|---|---|---|
| JP | 2001002063 | A | 1/2001 |
| WO | WO 2017/203393 | A1 | 11/2017 |

* cited by examiner

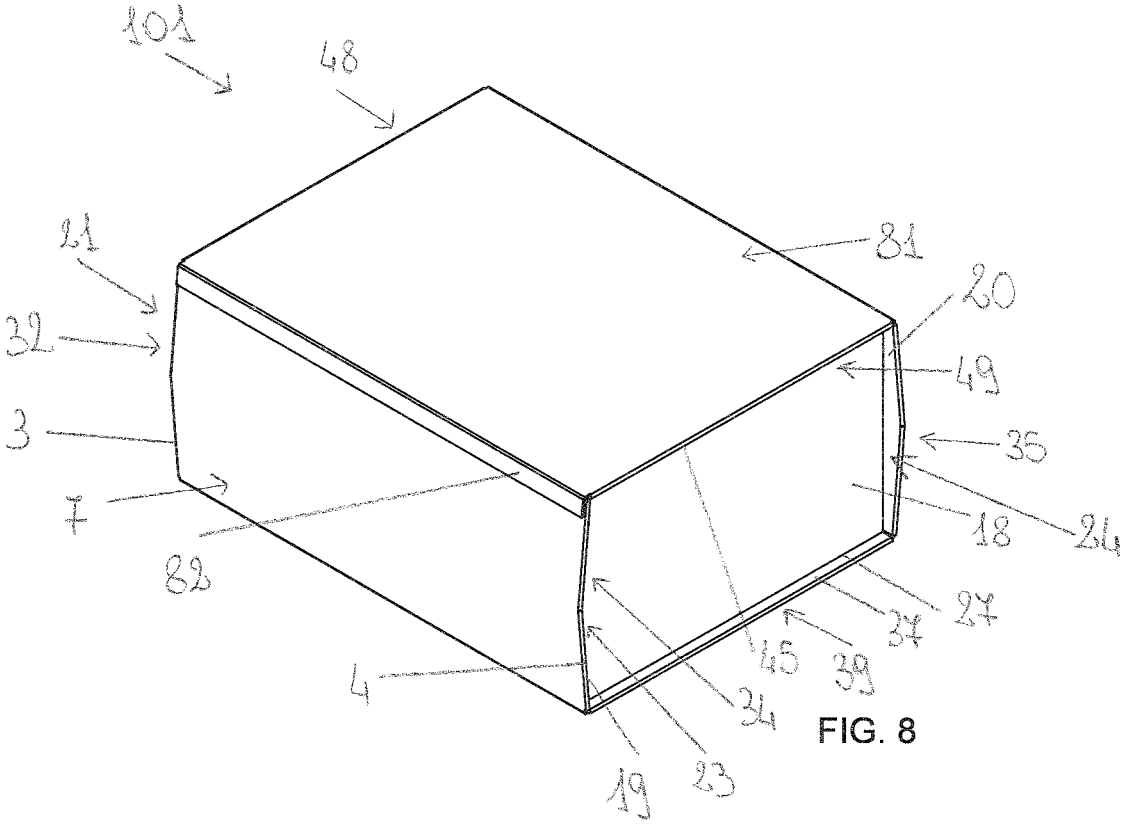
FIG. 8
FIG. 9
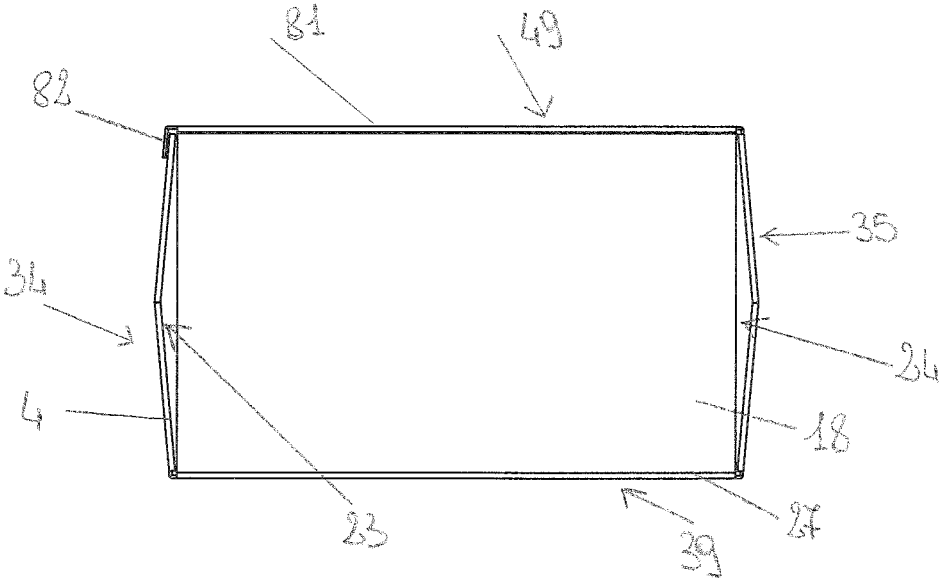

METHOD FOR REALISING A CARDBOARD BLANK FROM A CARDBOARD FOR PACKAGING AND FOR BOXING AT LEAST AN ARTICLE WITH THE CARDBOARD BLANK

FIELD OF THE INVENTION

The present invention relates to the technical sector of realising cardboard blanks from a cardboard sheet for packaging, and to the boxing of at least an article, such as, for example, books, dvd packaging and paper sheaf packaging, with the cardboard blanks.

DESCRIPTION OF THE PRIOR ART

With reference to European patent no. EP 2 890 554, in the name of the same Applicant, a method is known for realising a cardboard blank (1) from a cardboard for packaging and for boxing at least an article (2) with the cardboard blank (1).

The at least an article (2) comprises a first flank (2*a*), a second flank (2*b*) opposite the first flank (2*a*), a third flank (2*c*) comprised between the first flank (2*a*) and the second flank (2*b*), a fourth flank (2*d*) comprised between the first flank (2*a*) and the second flank (2*b*) and opposite the third flank (2*c*), a bottom (2*e*) and an upper face (2*f*) opposite the bottom (2*e*).

The known method preferably comprises the following steps (see FIGS. 1-7): providing a cardboard for packaging (100) which is flat; making a first score line (3) and a second score line (4) on the cardboard for packaging (100), so that the first score line (3) and the second score line (4) are parallel to one another and so that the following are identified: a central sector (5) comprised between the first score line (3) and the second score line (4), comprising a first portion (6), a second portion (7) and a third portion (8), the first portion (6) being interposed between the second portion (7) and the third portion (8); a first lateral sector (9) comprised between the first score line (3) and a first lateral end (100*a*) of the of the cardboard for packaging (100) and a second lateral sector (10) comprised between the second score line (4) and a second lateral end (100*b*) of the cardboard for packaging (100), which is opposite the first lateral end (100*a*) (see FIG. 1); carrying out a first cut (11), a second cut (12), a third cut (13) and a fourth cut (14) each made in a transversal direction to the first score line (3) and to the second score line (4) so that: the first cut (11) and the second cut (12) are carried out on the first lateral sector (9) and extend from the first lateral end (100*a*) of the cardboard for packaging (100) to the first score line (3), so that a first closing flap (15) is identified in the first lateral sector (9), foldable towards the first portion (6) and having a first edge (15*a*) and a second edge (15*b*) opposite one another, a first reinforcing flap (16) foldable towards the second portion (7) and a second reinforcing flap (17) foldable towards the third portion (8), the first closing flap (15) being interposed between the first reinforcing flap (16) and the second reinforcing flap (17); the third cut (13) and the fourth cut (14) are carried out on the second lateral sector (10) and extend from the second lateral end (100*b*) of the cardboard for packaging (100) to the second score line (4), so that a second closing flap (18) is identified in the second lateral sector (10), foldable towards the first portion (6) and having a third edge (18*a*) and a fourth edge (18*b*) opposite one another, a third reinforcing flap (19) foldable towards the second portion (7) and a fourth reinforcing flap (20) foldable towards the third portion (8), the second closing flap (18) being interposed between the third reinforcing flap (19) and the fourth reinforcing flap (20) (see FIG. 1). If the dimensions of the box (101) to be obtained exceed, by a predetermined value, the dimensions of the at least an article (2) to be boxed, then the known method includes cutting the cardboard for packaging (100) in order to reduce the dimensions of the box (101) to be obtained. Further, if the cardboard for packaging (100) is an integral part of a band of cardboard for packaging, cutting the cardboard for packaging (100) so as to obtain a cardboard sheet for packaging. Further, the known method comprises the following steps: arranging at least an article (2) on the first portion (6) so that the bottom (2*e*) of the at least an article (2) is arranged resting on the first portion (6); folding the first closing flap (15) with respect to the first score line (3) to cover at least the first flank (2*a*) of the at least an article (2); folding the second closing flap (18) with respect to the second score line (4) to cover at least the second flank (2*b*) of the at least an article (2); folding the second portion (7) to cover at least the third flank (2*c*) of the at least an article (2) with the consequence that the first reinforcing flap (16) is projecting with respect to the first closing flap (15) once the first closing flap (15) has been folded and the third reinforcing flap (19) is projecting with respect to the second closing flap (18) once the second closing flap (18) has been folded; folding the third portion (8) to cover at least the fourth flank (2*d*) and the upper face (2*f*) of the at least an article (2) with the consequence that the second reinforcing flap (17) is projecting with respect to the first closing flap (15) once the first closing flap (15) has been folded and the fourth reinforcing flap (20) is projecting with respect to the second closing flap (18) once the second closing flap (18) has been folded.

Further, the known method comprises the following steps: folding the first reinforcing flap (16) towards the second portion (7) with respect to the first score line (3) so as to overlap the first reinforcing flap (16) and the second portion (7) with respect to one another in order to define a first overlapping area (32); folding the second reinforcing flap (17) towards the third portion (8) with respect to the first score line (3) so as to overlap the second reinforcing flap (17) and the third portion (8) with respect to one another in order to define a second overlapping area (33); folding the third reinforcing flap (19) towards the second portion (7) with respect to the second score line (4) so as to overlap the third reinforcing flap (19) and the second portion (7) with respect to one another in order to define a third overlapping area (34); folding the fourth reinforcing flap (20) towards the third portion (8) with respect to the second score line (4) so as to overlap the fourth reinforcing flap (20) and the third portion (8) with respect to one another in order to define a fourth overlapping area (35). The step of folding the second portion (7) includes folding the second portion (7) with the consequence that a part of the first overlapping area (32) is projecting with respect to the first closing flap (15) once the first closing flap (15) has been folded and a part of the third overlapping area (34) is projecting with respect to the second closing flap (18) once the second closing flap (18) has been folded and the step of folding the third portion (8) includes folding the third portion (8) with the consequence that a part of the second overlapping area (33) is projecting with respect to the first closing flap (15) once the first closing flap (15) has been folded and a part of the fourth overlapping area (35) is projecting with respect to the second closing flap (18) once the second closing flap (18) has been folded (see FIGS. 2-4).

The known method further comprises the following steps: making a third score line (26) on the first closing flap (15) and a fourth score line (27) on the second closing flap (18) so that the first score line (3), the second score line (4), the third score line (26) and the fourth score line (27) are parallel to one another and wherein a first part (36) of the first closing flap (15) is defined, which is comprised between the first score line (3) and the third score line (26) and a second part (37) of the second closing flap (18) is defined, which is comprised between the second score line (4) and the fourth score line (27). The step of folding the first closing flap (15) can include folding the first closing flap (15) towards the first portion (6) with respect to the first score line (3) so as to overlap the first part (36) of the first closing flap (15) and the first portion (6) so as to define a fifth overlapping area (38) and further folding the first closing flap (15) with respect to the third score line (26) to cover at least the first flank (2*a*) of the at least an article (2) and the step of folding the second closing flap (18) includes folding the second closing flap (18) towards the first portion (6) with respect to the second score line (4) so as to overlap the second part (37) of the second closing flap (18) and the first portion (6) so as to define a sixth overlapping area (39) and further folding the second closing flap (18) with respect to the fourth score line (27) to cover at least the second flank (2*b*) of the at least an article (2) (see FIGS. 1-4).

The third portion (8) comprises a fourth portion (80) and a fifth portion (81), the fourth portion (80) being interposed between the first portion (6) and the fifth portion (81). The second reinforcing flap (17) is hinged to a first end (8*a*) of the fourth portion (80) and is foldable against the fourth portion (80), the first end (8*a*) of the fourth portion (80) being a part of a first end (8*c*) of the third portion (8) and the fourth reinforcing flap (20) is hinged to a second end (8*b*) of the fourth portion (80) and is foldable against the fourth portion (80), the second end (8*b*) of the fourth portion (80) being a part of a second end (8*d*) of the third portion (8) (see FIG. 1). The known method preferably comprises the following steps: carrying out a fifth cut (42) and a sixth cut (43) each made in a transversal direction to the first score line (3) and to the second score line (4) so that: the fifth cut (42) is carried out on the first lateral sector (9) and extends from the first lateral end (100*a*) of the cardboard for packaging (100) to the first score line (3), so that a fifth reinforcing flap (44) is identified in the first lateral sector (9), which fifth reinforcing flap (44) is foldable towards the fifth portion (81) and the sixth cut (43) is carried out on the second lateral sector (10) and extends from the second lateral end (100*b*) of the cardboard for packaging (100) to the second score line (4), so that a sixth reinforcing flap (45) is identified in the second lateral sector (10), which sixth reinforcing flap (45) is foldable towards the fifth portion (81) (see FIG. 1); folding the fourth portion (80) to cover at least the fourth flank (2*d*) of the at least an article (2); folding the fifth portion (81) to cover at least the upper face (2*f*) of the at least an article (2) with the consequence that the fifth reinforcing flap (44) is projecting with respect to the first closing flap (15) once the first closing flap (15) has been folded and the sixth reinforcing flap (45) is projecting with respect to the second closing flap (18) once the second closing flap (18) has been folded; folding the fifth reinforcing flap (44) towards the fifth portion (81) with respect to the first score line (3) so as to overlap the fifth reinforcing flap (44) and the fifth portion (81) with respect to one another in order to define a seventh overlapping area (48); folding the sixth reinforcing flap (45) towards the fifth portion (81) with respect to the second score line (4) so as to overlap the sixth reinforcing flap (45) and the fifth portion (81) with respect to one another in order to define an eighth overlapping area (49). The step of folding the fifth portion (81) can include folding the fifth portion (81) with the consequence that a part of the seventh overlapping area (48) is projecting with respect to the first closing flap (15) once the first closing flap (15) has been folded and a part of the eighth overlapping area (49) is projecting with respect to the second closing flap (18) after the second closing flap (18) has been folded (see FIGS. 4-7).

Further, the fifth portion (81) comprises a contact strip (82) which extends parallel to a free end (7*c*) of the second portion (7) and which entirely contacts the second portion (7) when the third portion (8) and the second portion (7) are folded and overlapped on one another (see FIGS. 4-7).

FIGS. 8 and 9 show a box (101) of large dimensions: in this case, the second portion (7) and part of the third portion (8) can flex, moving away from the first closing flap (15) and from the second closing flap (18), so that a first opening (21) is defined between the first edge (15*a*) and the first reinforcing flap (16), a second opening (not illustrated) between the second edge (15*b*) and the second reinforcing flap (17), a third opening (23) between the third edge (18*a*) and the third reinforcing flap (19) and a fourth opening (24) of the fourth edge (18*b*) and the fourth reinforcing flap (20).

This flexion of the second portion (7) and the third portion (8) can also occur when weights are bearing down on the box (101), for example when other boxes are stacked thereon.

In cases of this type the box (101) tends to collapse, which is a drawback.

As can be understood from FIG. 9, in some cases it is possible to extract the at least an article (2) which is contained inside the box (101), for example with one hand or using grippers or like tools: the step of extraction of the at least an article (2) can lead to a temporary broadening of the opening (21, 23, 24) in question, which however leaves no visible signs of tampering.

As a consequence, the user receiving the box (101) from a courier might notice the lack of one or more articles from the box (101) only after having opened the box (101), once the courier has left. A query lodged thereafter by the user might therefore not be accepted by the company that sent the box (101), as the user cannot demonstrate that the missing articles have effectively been extracted illicitly before delivery was made.

The possibility of extracting the at least an article (2) from the box (101) in the way described above can also occur when the openings (21, 23, 24) described above are not visible, due to the fact that the box (101) can be reversibly deformed, within a certain limit, without there being visible signs of tampering following the act itself, which can be observed by the user at the moment of delivery by the courier.

Further, third parties, through the first opening (21), the second opening, the third opening (23) and the fourth opening (24), might insert further articles, or undesired articles, inside the box.

SUMMARY OF THE INVENTION

The aim of the invention consists in overcoming the above-described drawback.

The above-described aim is attained with a method for realising a cardboard blank from a cardboard for packaging and for boxing at least an article with the cardboard blank, according to claim 1.

The strapping band advantageously makes the above-mentioned openings inaccessible.

The application of a strapping band enables obtaining a closure of the above-mentioned openings in a safe and durable way.

Further, the folding of the first reinforcing flap and the second reinforcing flap towards the first closing flap and the third reinforcing flap and fourth reinforcing flap towards the second closing flap also increases the rigidity of the box obtained, preventing a possible collapse of the box, for example owing to an overlying weight.

BRIEF DESCRIPTION OF THE DRAWINGS

Specific embodiments of the invention will be described in the following part of the description, according to what is included in the claims and with the aid of the appended tables of drawings, in which:

FIGS. 8 and 9 are, respectively, a perspective view and a lateral view of a box realised using the known method;

DESCRIPTION OF THE PREFERRED EMBODIMENTS

In the following, reference is made to FIGS. 1-7 and 10-11.

It is specified that, in the following part of the present description, by cardboard blank (1) is meant a cardboard sheet profiled by a die-cutter to give it a determined shape. Further, in the following part of the present description, the term cardboard for packaging (100) can be understood to means a cardboard sheet for packaging or a band of cardboard for packaging from which a cardboard sheet for packaging can be obtained by cutting.

Figure 1:
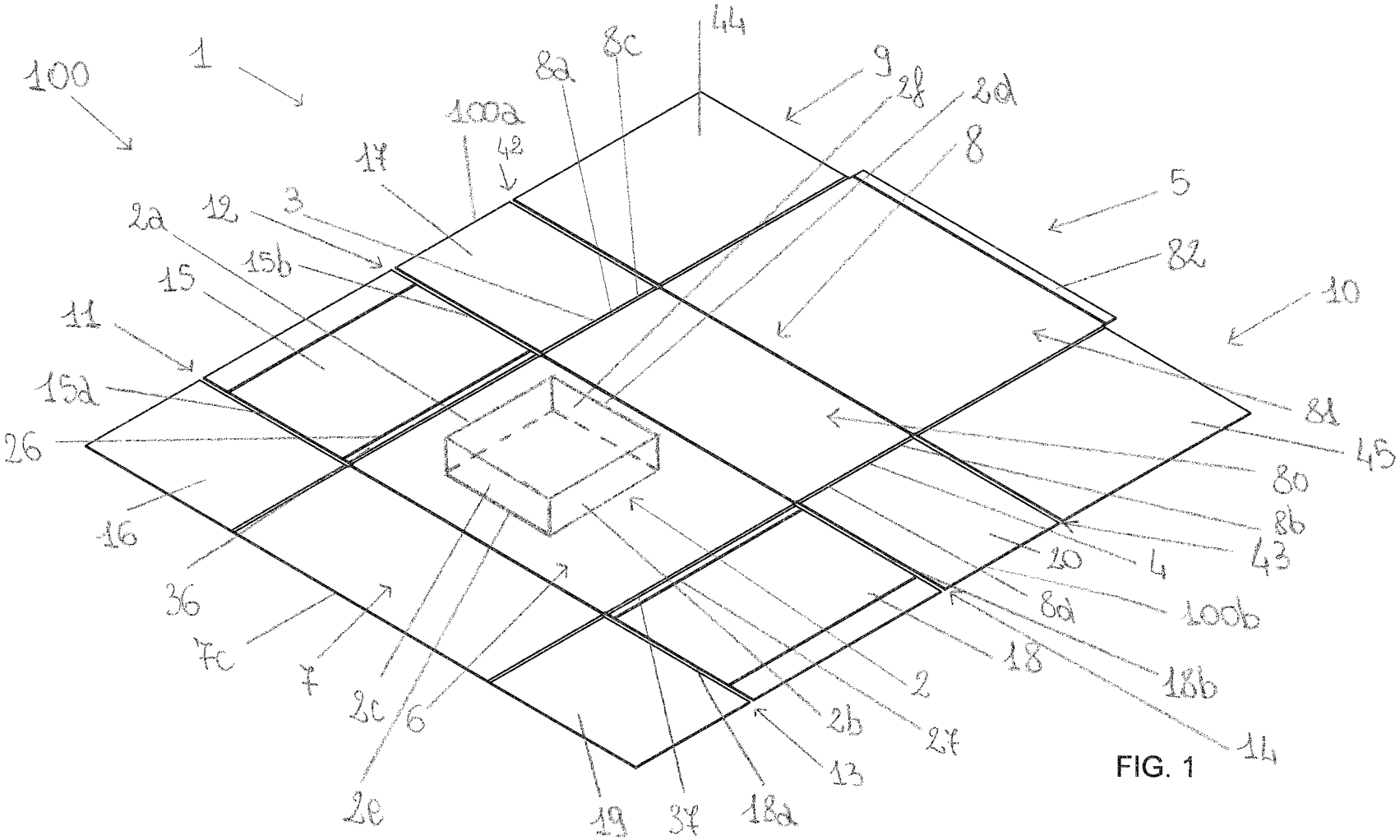
FIGS. 1-7 are perspective views which illustrate some steps of the known method for realising a cardboard blank from a cardboard for packaging and for boxing at least an article with the cardboard blank.

A method for realising a cardboard blank (1) from a cardboard for packaging (100) and for boxing at least an article (2) with the cardboard blank (1), wherein the at least an article (2) comprises a first flank (2*a*), a second flank (2*b*) opposite the first flank (2*a*), a third flank (2*c*) comprised between the first flank (2*a*) and the second flank (2*b*), a fourth flank (2*d*) comprised between the first flank (2*a*) and the second flank (2*b*) and opposite the third flank (2*c*), a bottom (2*e*) and an upper face (2*f*) opposite the bottom (2*e*), comprising following steps: providing a cardboard for packaging (100) which is flat; making a first score line (3) and a second score line (4) on the cardboard for packaging (100), so that the first score line (3) and the second score line (4) are parallel to one another and so that the following are identified: a central sector (5) comprised between the first score line (3) and the second score line (4), comprising a first portion (6), a second portion (7) and a third portion (8), the first portion (6) being interposed between the second portion (7) and the third portion (8); a first lateral sector (9) comprised between the first score line (3) and a first lateral end (100*a*) of the of the cardboard for packaging (100) and a second lateral sector (10) comprised between the second score line (4) and a second lateral end (100*b*) of the cardboard for packaging (100), which is opposite the first lateral end (100*a*) (see FIG. 1); carrying out a first cut (11), a second cut (12), a third cut (13) and a fourth cut (14) each made in a transversal direction to the first score line (3) and to the second score line (4) so that: the first cut (11) and the second cut (12) are carried out on the first lateral sector (9) and extend from the first lateral end (100*a*) of the cardboard sheet for packaging (100) to the first score line (3), so that a first closing flap (15) is identified in the first lateral sector (9), foldable towards the first portion (6) and having a first edge (15*a*) and a second edge (15*b*) opposite one another, a first reinforcing flap (16) foldable towards the second portion (7) and a second reinforcing flap (17) foldable towards the third portion (8), the first closing flap (15) being interposed between the first reinforcing flap (16) and the second reinforcing flap (17); the third cut (13) and the fourth cut (14) are carried out on the second lateral sector (10) and extend from the second lateral end (100*b*) of the cardboard sheet for packaging (100) to the second score line (4), so that a second closing flap (18) is identified in the second lateral sector (10), foldable towards the first portion (6) and having a third edge (18*a*) and a fourth edge (18*b*) opposite one another, a third reinforcing flap (19) foldable towards the second portion (7) and a fourth reinforcing flap (20) foldable towards the third portion (8), the second closing flap (18) being interposed between the third reinforcing flap (19) and the fourth reinforcing flap (20) (see FIG. 1). If the dimensions of the box (101) to be obtained exceed, by a predetermined value, the dimensions of the at least an article (2) to be boxed, cutting the cardboard sheet for packaging (100) in order to reduce the dimensions of the box (101) to be obtained. Further, if the cardboard for packaging (100) is an integral part of a band of cardboard for packaging, cutting the cardboard for packaging (100) so as to obtain a cardboard sheet for packaging. Further, the method can comprise the following steps: arranging at least an article (2) on the first portion (6) so that the bottom (2*e*) of the at least an article (2) is arranged resting on the first portion (6); folding the first closing flap (15) with respect to the first score line (3) to cover at least the first flank (2*a*) of the at least an article (2) (see FIG. 2); folding the second closing flap (18) with respect to the second score line (4) to cover at least the second flank (2*b*) of the at least an article (2) (see FIG. 2); folding the second portion (7) to cover at least the third flank (2*c*) of the at least an article (2) with the consequence that the first reinforcing flap (16) is projecting with respect to the first closing flap (15) once the first closing flap (15) has been folded and the third reinforcing flap (19) is projecting with respect to the second closing flap (18) once the second closing flap (18) has been folded; folding the third portion (8) to cover at least the fourth flank (2*d*) and the upper face (2*f*) of the at least an article (2) with the consequence that the second reinforcing flap (17) is projecting with respect to the first closing flap (15) once the first closing flap (15) has been folded and the fourth reinforcing flap (20) is projecting with respect to the second closing flap (18) once the second closing flap (18) has been folded (see FIGS. 4-6); tightening a strapping band (25) about the second portion (7), the first reinforcing flap (16), the first closing flap (15), the second reinforcing flap (17), the third portion (8), the fourth reinforcing flap (20), the second closing flap (18) and the third reinforcing flap (19), so as to cause: the folding of the first reinforcing flap (16) towards the first closing flap (15) with a consequent covering of the first edge (15*a*) of the first closing flap (15); the folding of the second reinforcing flap (17) towards the first closing flap (15) with a consequent covering of the second edge (15*b*) of the first closing flap (15); the folding of the third reinforcing flap (19) towards the second closing flap (18) with a consequent covering of the third edge (18*a*) of the second closing flap (18); the folding of the fourth reinforcing flap (20) towards the second closing flap (18) with a consequent covering of the fourth edge (18*b*) of the second closing flap (18) (see FIGS. 10-14).

By way of example, to establish whether the dimensions of the box (101) to be obtained exceed, by a predetermined value, the dimensions of the at least an article (2) to be boxed, the method can comprise the following steps: estimating the dimensions of the at least an article (2) to be arranged on the first portion (6); estimating the volumes occupied by the at least an article (2) to be arranged on the first portion (6); measuring the dimensions of the cardboard blank (1) with which the at least an article (2) will be boxed and, therefore, the dimensions of the box (101) to be obtained; establishing the value relative to how much the dimensions of the box (101) exceed the dimensions of the at least an article (2) and relating it to the predetermined value.

With particular reference to FIG. 1, the first closing flap (15) faces the second closing flap (18) with respect to the first portion (6).

Again with reference to FIG. 1, the first reinforcing flap (16) faces the third reinforcing flap (19) with respect to the second portion (7) and the second reinforcing flap (17) faces the fourth reinforcing flap (20) with respect to the third portion (8).

When the cardboard sheet for packaging (100) is in the flat configuration, the first edge (15*a*) of the first closing flap (15) faces the first reinforcing flap (16), the second edge (15*b*) of the first closing flap (15) faces the third reinforcing flap (19), the third edge (18*a*) of the second closing flap (18) faces the third reinforcing flap (19) and the fourth edge (18*b*) of the second closing flap (18) faces the fourth reinforcing flap (20).

The method for realising a cardboard blank (1) from a cardboard sheet for packaging (100) and for boxing at least an article (2) with the cardboard blank (1) comprises following steps: folding the first reinforcing flap (16) towards the second portion (7) with respect to the first score line (3) so as to overlap the first reinforcing flap (16) and the second portion (7) with respect to one another in order to define a first overlapping area (32); folding the second reinforcing flap (17) towards the third portion (8) with respect to the first score line (3) so as to overlap the second reinforcing flap (17) and the third portion (8) with respect to one another in order to define a second overlapping area (33); folding the third reinforcing flap (19) towards the second portion (7) with respect to the second score line (4) so as to overlap the third reinforcing flap (19) and the second portion (7) with respect to one another in order to define a third overlapping area (34); folding the fourth reinforcing flap (20) towards the third portion (8) with respect to the second score line (4) so as to overlap the fourth reinforcing flap (20) and the third portion (8) with respect to one another in order to define a fourth overlapping area (35).

The first score line (3) can include two score lines parallel and opposite one another, and neared to each other.

Likewise, the second score line (4) can include two score lines parallel and opposite one another, and near to each other.

Figure 2:
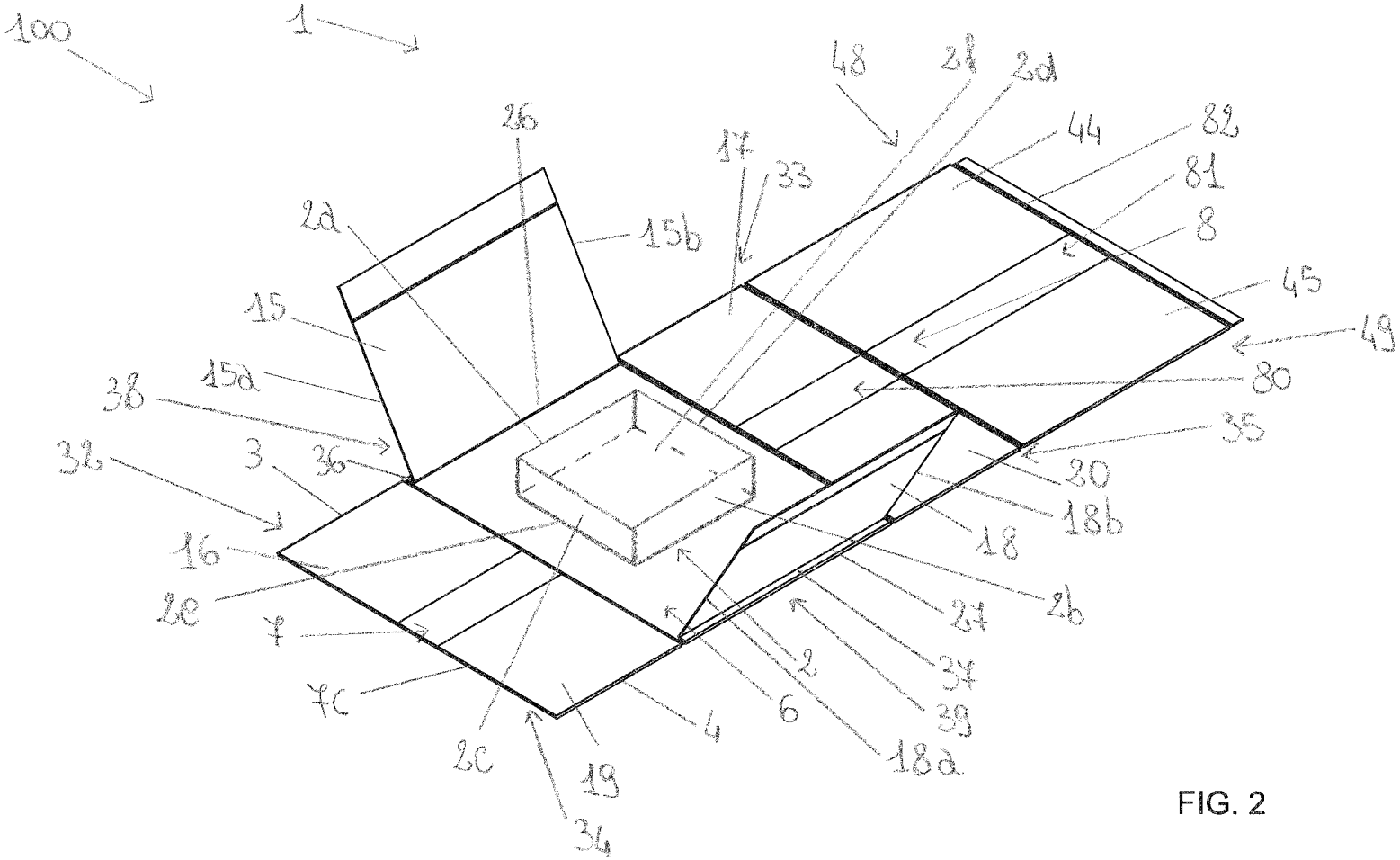
Figure 3:
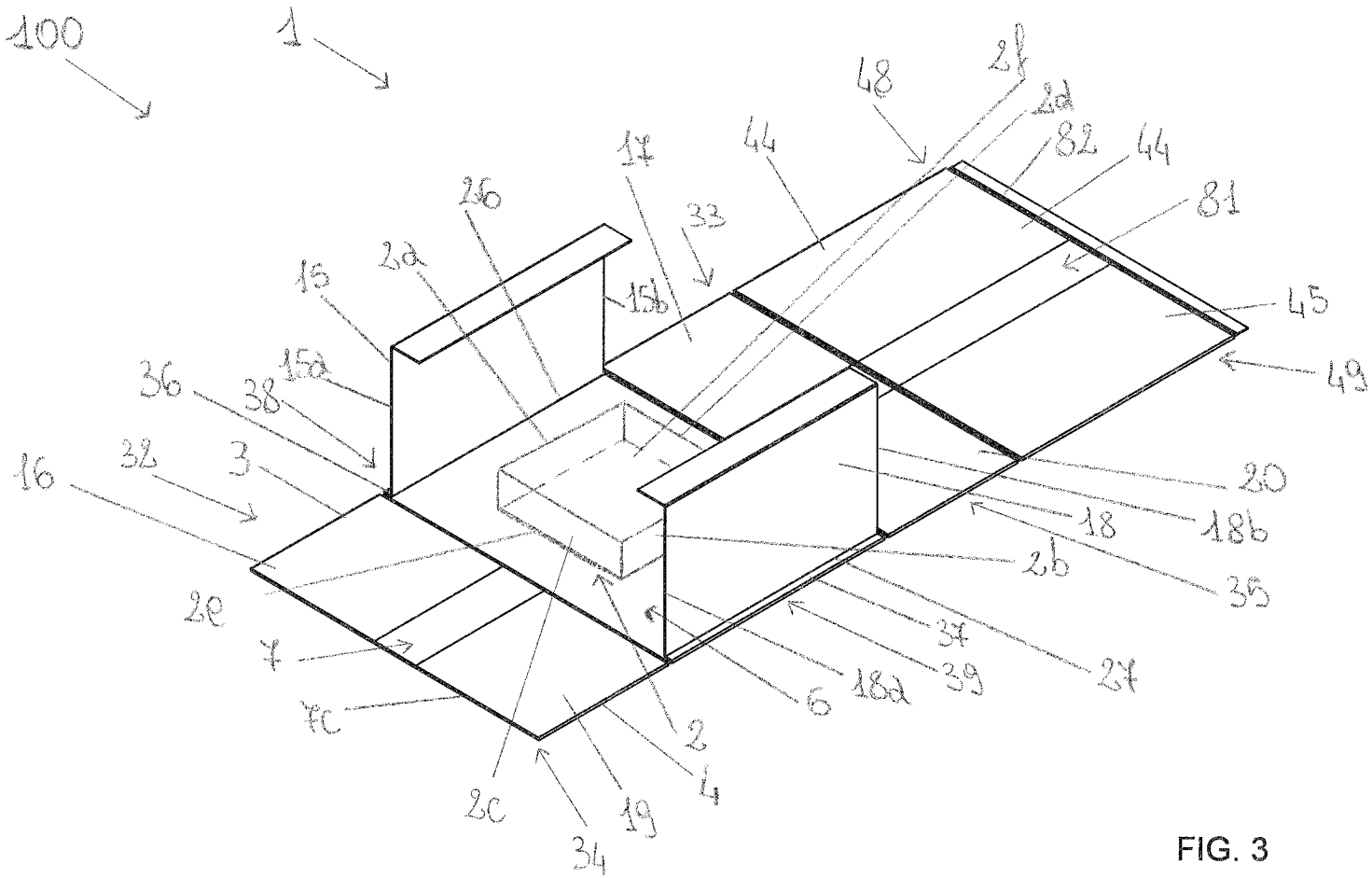
Figure 4:
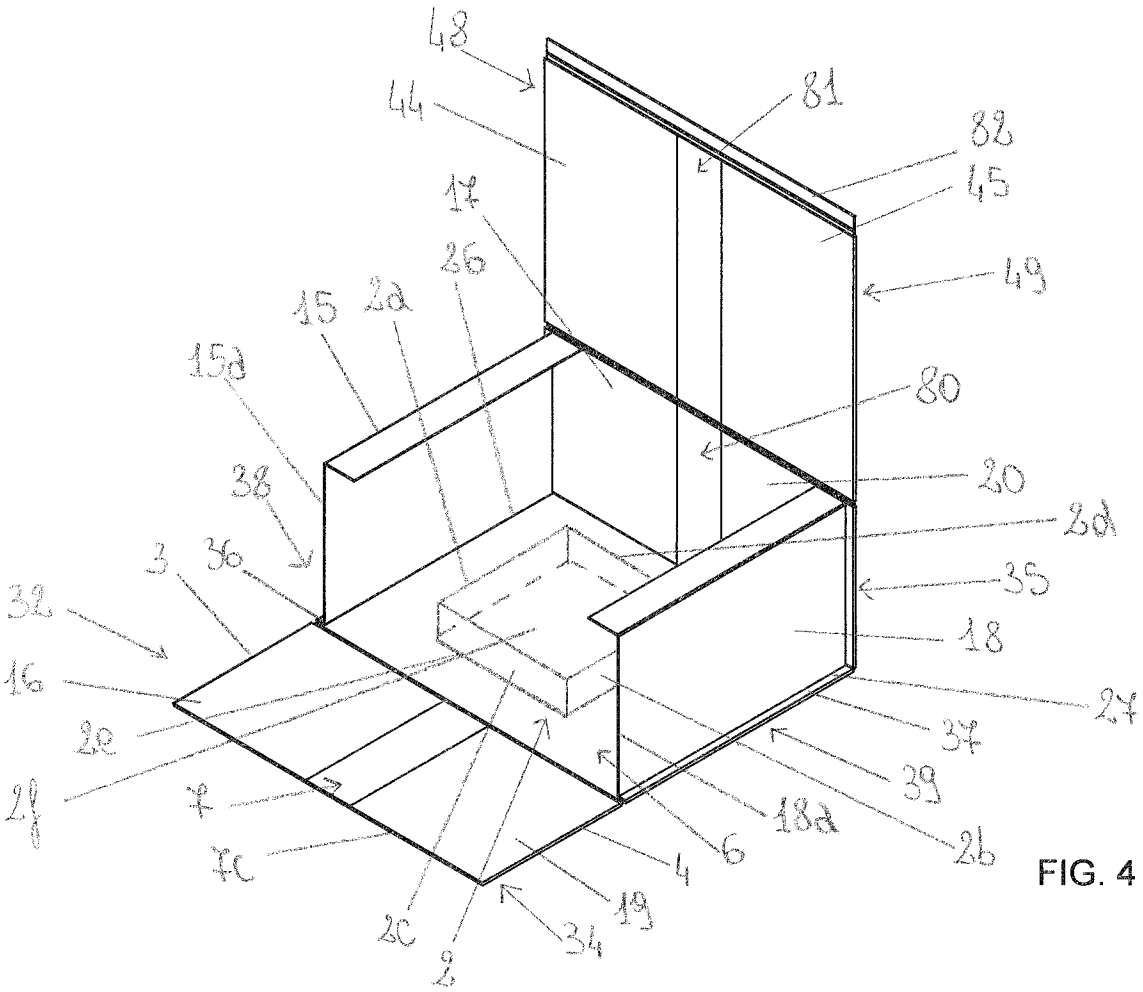
Figure 5:
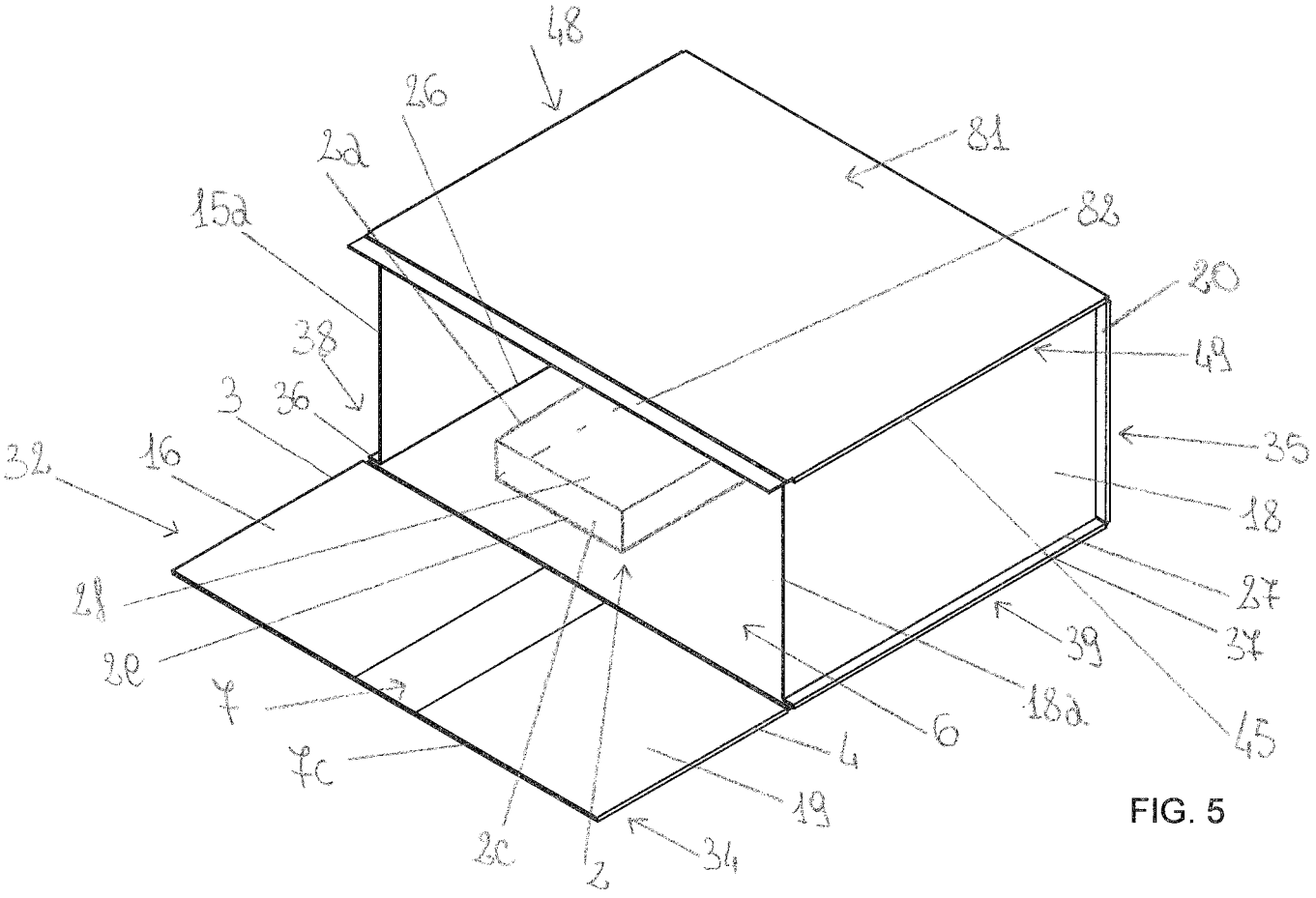

The step of folding the second portion (7) can include folding the second portion (7) with the consequence that a part of the first overlapping area (32) is projecting with respect to the first closing flap (15) once the first closing flap (15) has been folded and a part of the third overlapping area (34) is projecting with respect to the second closing flap (18) once the second closing flap (18) has been folded and the step of folding the third portion (8) can include folding the third portion (8) with the consequence that a part of the second overlapping area (33) is projecting with respect to the first closing flap (15) once the first closing flap (15) has been folded and a part of the fourth overlapping area (35) is projecting with respect to the second closing flap (18) once the second closing flap (18) has been folded (see FIGS. 1-3). The step of tightening the strapping band can be such as to cause: the folding of the projecting part of the first overlapping area (33) towards the first closing flap (15) with a consequent covering of the first edge (15*a*) of the first closing flap (15); the folding of the projecting part of the second overlapping area (33) towards the first closing flap (15) with a consequent covering of the second edge (15*b*) of the first closing flap (15); the folding of the projecting part of the third overlapping area (34) towards the second closing flap (18) with a consequent covering of the third edge (18*a*) of the second closing flap (18); the folding of the projecting part of the fourth overlapping area (35) towards the second closing flap (18) with a consequent covering of the fourth edge (18*b*) of the second closing flap (18) (see FIGS. 10-11 and 12-14).

The folding of the projecting part of the first overlapping area (32) and of the projecting part of the second overlapping area (33) towards the first closing flap (15) and the folding of the projecting part of the third overlapping area (34) and the projecting part of the fourth overlapping area (35) towards the second closing flap (18) make the structure of the box (101) obtained more rigid.

In other words, since the first overlapping area (32) is determined by the superposing of the first reinforcing flap (16) and part of the second portion (7) and since the third overlapping area (34) is determined by the superposing of the third reinforcing flap (19) and part of the second portion (7), the first overlapping area (32) and the third overlapping area (34) have a greater thickness, respectively, than the first reinforcing flap (16) and the third reinforcing flap (19) and this contributes to increasing the rigidity of the box (101), once the second portion (7) has been folded and the strapping band (25) has been tightened.

Like considerations can be made on the second overlapping area (33) and on the fourth overlapping area (35) as, since the second overlapping area (33) is determined by the superposing of the second reinforcing flap (17) and part of the third portion (8) and since the fourth overlapping area (35) is determined by the superposing of the fourth reinforcing flap (20) and part of the third portion (8), the second overlapping area (33) and the fourth overlapping area (35) have a greater thickness, respectively, than the second reinforcing flap (17) and the fourth reinforcing flap (20) and this contributes to increasing the rigidity of the box (101), once the third portion (8) has been folded and the strapping band (25) has been tightened.

By increasing the rigidity of the box (101) it will be possible to superpose several boxes on one another, thus maximising the storage capacity of a storehouse or a lorry for transport. Further, by increasing the rigidity of the box (101), a greater degree of safety is ensured of the at least an article (2) present inside, since with a rigid box (101), which suffers less from external actions, the possibility that these external actions can damage the at least an article (2) present in the box is reduced.

Further, as well as increasing the rigidity of the box, (101), the above-mentioned projecting parts of the overlapping areas (32, 33, 34, 35) represent a protection for the sides of the box (101) itself that, as is well-known, are the weakest parts of a box (101).

The method of the present invention can comprise a step of gluing the first reinforcing flap (16) on the second portion (7) once folded towards the second portion (7) and a step of gluing the third reinforcing flap (19) on the second portion (7) once folded towards the second portion (7).

Further, the method of the present invention can comprise a step of gluing the second reinforcing flap (17) on the third portion (8) once folded towards the third portion (8) and a step of gluing the fourth reinforcing flap (20) on the third portion (8) once folded towards the third portion (8).

The superposing of the first reinforcing flap (16) on part of the second portion (7), the third reinforcing flap (19) on part of the second portion (7), the second reinforcing flap (17) on part of the third portion (8) and the fourth reinforcing flap (20) on part of the third portion (8) enables realising a padding inside the box (101), on which the at least an article (2), arranged inside the box (101), can advantageously impact without suffering any particular damage.

The method can preferably comprise the following steps: making a third score line (26) on the first closing flap (15) and a fourth score line (27) on the second closing flap (18) so that the first score line (3), the second score line (4), the third score line (26) and the fourth score line (27) are parallel to one another and wherein a first part (36) of the first closing flap (15) is defined, which is comprised between the first score line (3) and the third score line (26) and a second part (37) of the second closing flap (18) is defined, which is comprised between the second score line (4) and the fourth score line (27). The step of folding the first closing flap (15) can include folding the first closing flap (15) towards the first portion (6) with respect to the first score line (3) so as to overlap the first part (36) of the first closing flap (15) and the first portion (6) so as to define a fifth overlapping area (38) and further folding the first closing flap (15) with respect to the third score line (26) to cover at least the first flank (2*a*) of the at least an article (2) and the step of folding the second closing flap (18) can include folding the second closing flap (18) towards the first portion (6) with respect to the second score line (4) so as to overlap the second part (37) of the second closing flap (18) and the first portion (6) so as to define a sixth overlapping area (39) and further folding the second closing flap (18) with respect to the fourth score line (27) to cover at least the second flank (2*b*) of the at least an article (2) (see FIGS. 2-4).

The projecting part of the fifth overlapping area (38) and the projecting part of the sixth overlapping area (39) advantageously make the frame of the box (101) obtained more rigid.

In other words, since the fifth overlapping area (38) is determined by the superposing of the first part (36) of the first closing flap (15) and part of the first portion (6) and since the sixth overlapping area (39) is determined by the superposing of the second part (37) of the second closing flap (18) and part of the first portion (6), the fifth overlapping area (38) and the sixth overlapping area (39) have a greater thickness, respectively, than the first closing flap (15) and the second closing flap (18) and this contributes to increasing the rigidity of the box (101).

Regarding this last aspect, the above considerations on the advantages linked to having a more rigid box (101) are valid.

The third score line (26) can include two score lines parallel and opposite one another, and near to each other.

Likewise, the fourth score line (27) can include two score lines parallel and opposite one another, and near to each other.

Further, the projecting part of the fifth overlapping area (38) and the projecting part of the sixth overlapping area (39) advantageously make the handling of the box (101) obtained easier as the person who will have to handle the box (101) can identify in the projecting part of the fifth overlapping area (38) and the projecting part of the sixth overlapping area (39) a gripping point of the box (101).

The method of the present invention can comprise the step of gluing the first part (36) of the first closing flap (15) on the first portion (6) once the first closing flap (15) is folded towards the first portion (6) and the step of gluing the second part (37) of the second closing flap (18) on the first portion (6) once the second closing flap (18) is folded towards the first portion (6).

The step of tightening the strapping band (25) comprises the step of tightening a plurality of strapping bands (40) about the second portion (7), the first reinforcing flap (16), the first closing flap (15), the second reinforcing flap (17), the third portion (8), the fourth reinforcing flap (20), the second closing flap (18) and the third reinforcing flap (19), which strapping bands (25) of the plurality of strapping bands (40) are arranged distanced from one another (see FIGS. 10-14).

The plurality of strapping bands (40) advantageously ensures a covering of the first edge (15*a*), the second edge (15*b*), the third edge (18*a*) and the fourth edge (18*b*) that is more secure and durable over time with respect to a single strapping band (25).

With reference to FIGS. 1-7, the third portion (8) comprises a fourth portion (80) and a fifth portion (81), the fourth portion (80) being interposed between the first portion (6) and the fifth portion (81); the second reinforcing flap (17) is hinged to a first end (8*a*) of the fourth portion (80) and is foldable against the fourth portion (80), the first end (8*a*) of the fourth portion (80) being a part of a first end (8*c*) of the third portion (8); the fourth reinforcing flap (20) is hinged to a second end (8*b*) of the fourth portion (80) and is foldable against the fourth portion (80), the second end (8*b*) of the fourth portion (80) being a part of a second end (8*d*) of the third portion (8). Further, the method can comprise the following steps: carrying out a fifth cut (42) and a sixth cut (43) each made in a transversal direction to the first score line (3) and to the second score line (4) so that: the fifth cut (42) is carried out on the first lateral sector (9) and extends from the first lateral end (100*a*) of the cardboard for packaging (100) to the first score line (3), so that a fifth reinforcing flap (44) is identified in the first lateral sector (9), which fifth reinforcing flap (44) is foldable towards the fifth portion (81) and the sixth cut (43) is carried out on the second lateral sector (10) and extends from the second lateral end (100*b*) of the cardboard for packaging (100) to the second score line (4), so that a sixth reinforcing flap (45) is identified in the second lateral sector (10), which sixth reinforcing flap (45) is foldable towards the fifth portion (81); folding the fourth portion (80) to cover at least the fourth flank (2*d*) of the at least an article (2); folding the fifth portion (81) to cover at least the upper face (2*f*) of the at least an article (2) with the consequence that the fifth reinforcing flap (44) is projecting with respect to the first closing flap (15) once the first closing flap (15) has been folded and the sixth reinforcing flap (45) is projecting with respect to the second closing flap (18) once the second closing flap (18) has been folded.

Further, the method can comprise the following steps: folding the fifth reinforcing flap (44) towards the fifth portion (81) with respect to the first score line (3) so as to overlap the fifth reinforcing flap (44) and the fifth portion (81) with respect to one another in order to define a seventh overlapping area (48); folding the sixth reinforcing flap (45) towards the fifth portion (81) with respect to the second score line (4) so as to overlap the sixth reinforcing flap (45) and the fifth portion (81) with respect to one another in order to define an eighth overlapping area (49). The step of folding the fifth portion (81) can include folding the fifth portion (81) with the consequence that a part of the seventh overlapping area (48) is projecting with respect to the first closing flap (15) once the first closing flap (15) has been folded and a part of the eighth overlapping area (49) is projecting with respect to the second closing flap (18) after the second closing flap (18) has been folded.

The projecting part of the seventh overlapping area (48) and the projecting part of the eighth overlapping area (49) make the structure of the box (101) obtained more rigid.

In other words, since the seventh overlapping area (48) is determined by the superposing of the fifth closing flap (44) and part of the fifth portion (80) and since the eighth overlapping area (49) is determined by the superposing of the sixth closing flap (45) and part of the fifth portion (81), the seventh overlapping area (48) and the eighth overlapping area (49) have a greater thickness, respectively, than the fifth reinforcing flap (44) and the sixth reinforcing flap (45) and this contributes to increasing the rigidity of the box (101).

Regarding this last aspect, the above considerations on the advantages linked to having a more rigid box (101) are valid.

Further, the projecting part of the seventh overlapping area (48) and the projecting part of the eighth overlapping area (49) advantageously make the handling of the box (101) obtained easier as the person who will have to handle the box (101) can identify in the projecting part of the seventh overlapping area (48) and the projecting part of the eighth overlapping area (49) a gripping point of the box (101).

Figure 6:
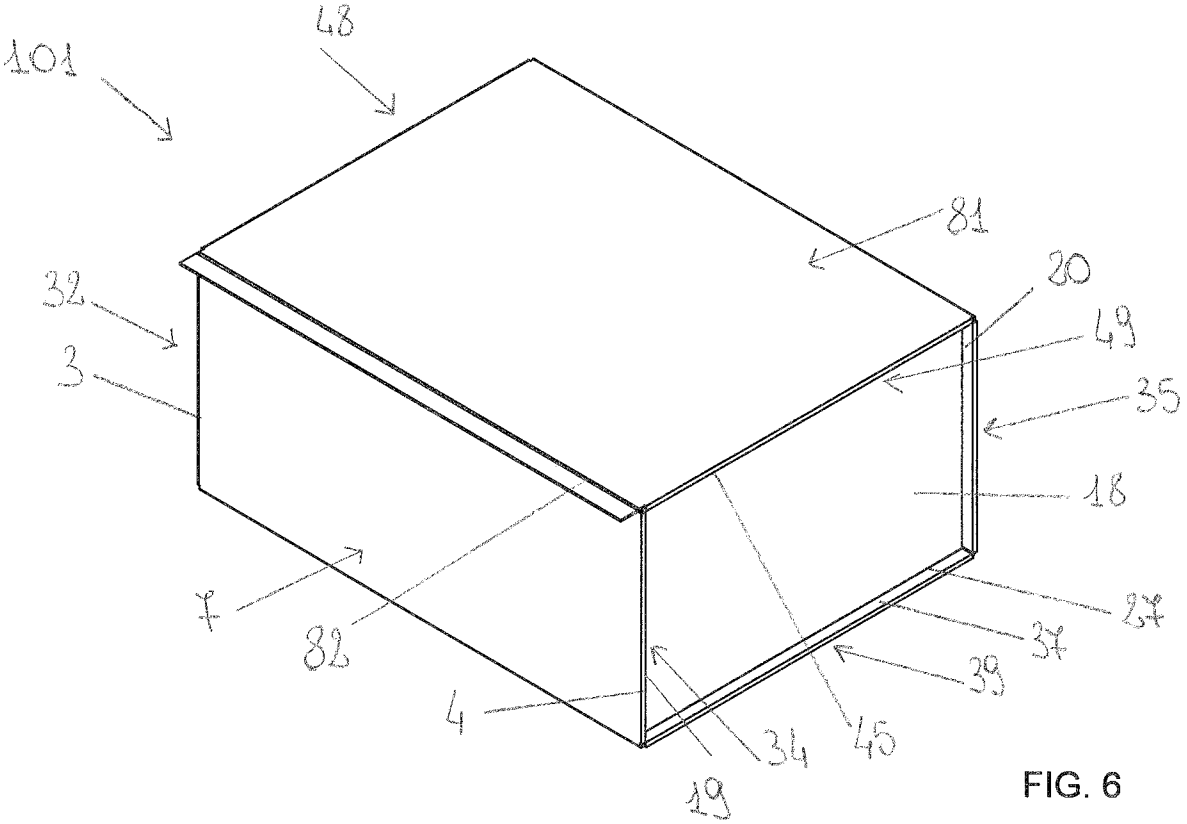
Figure 7:
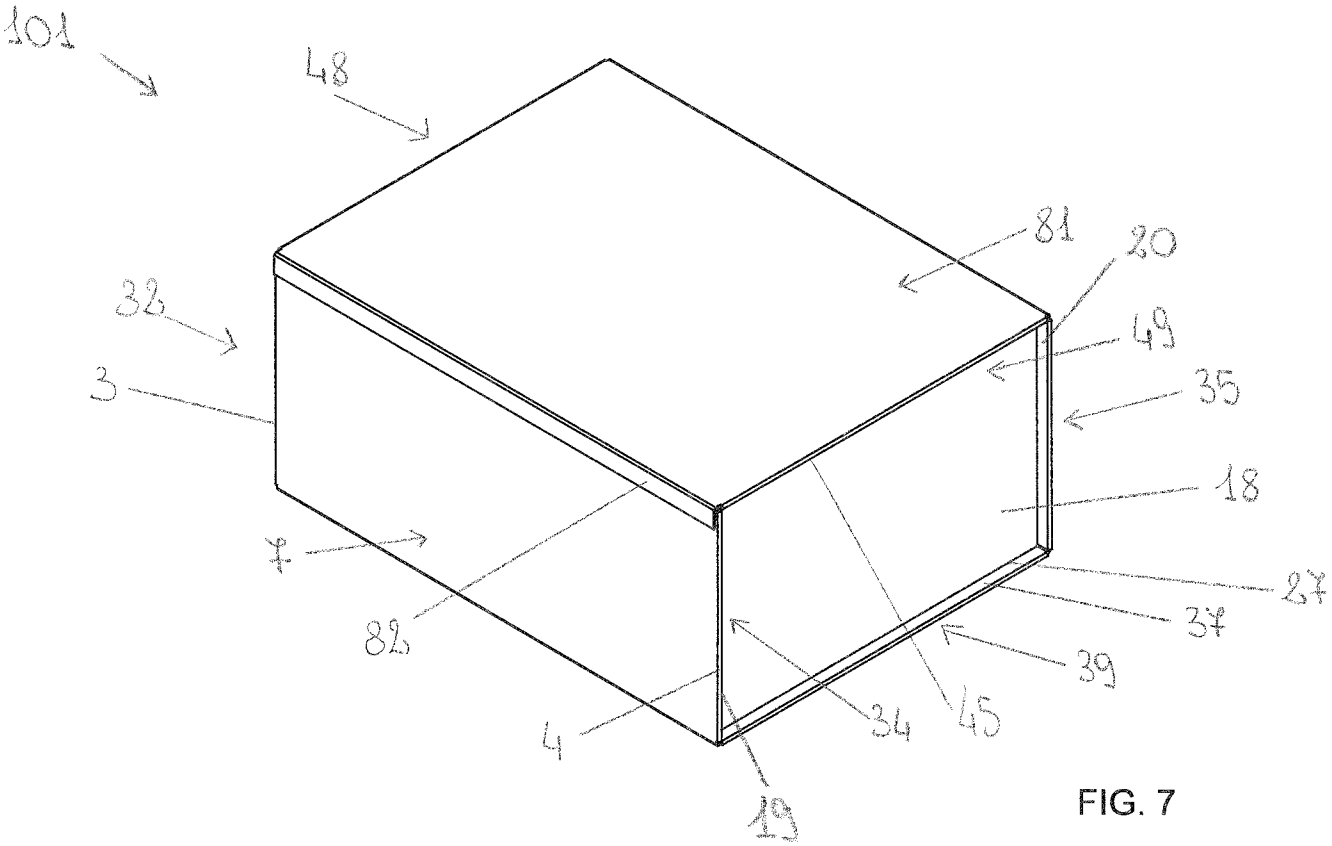
Figure 11:
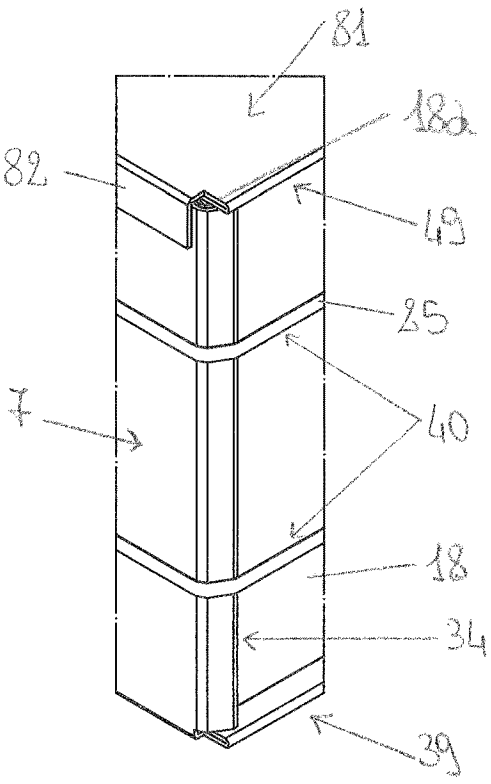
FIG. 11 is a view of detail W of FIG. 10.
Figure 10:
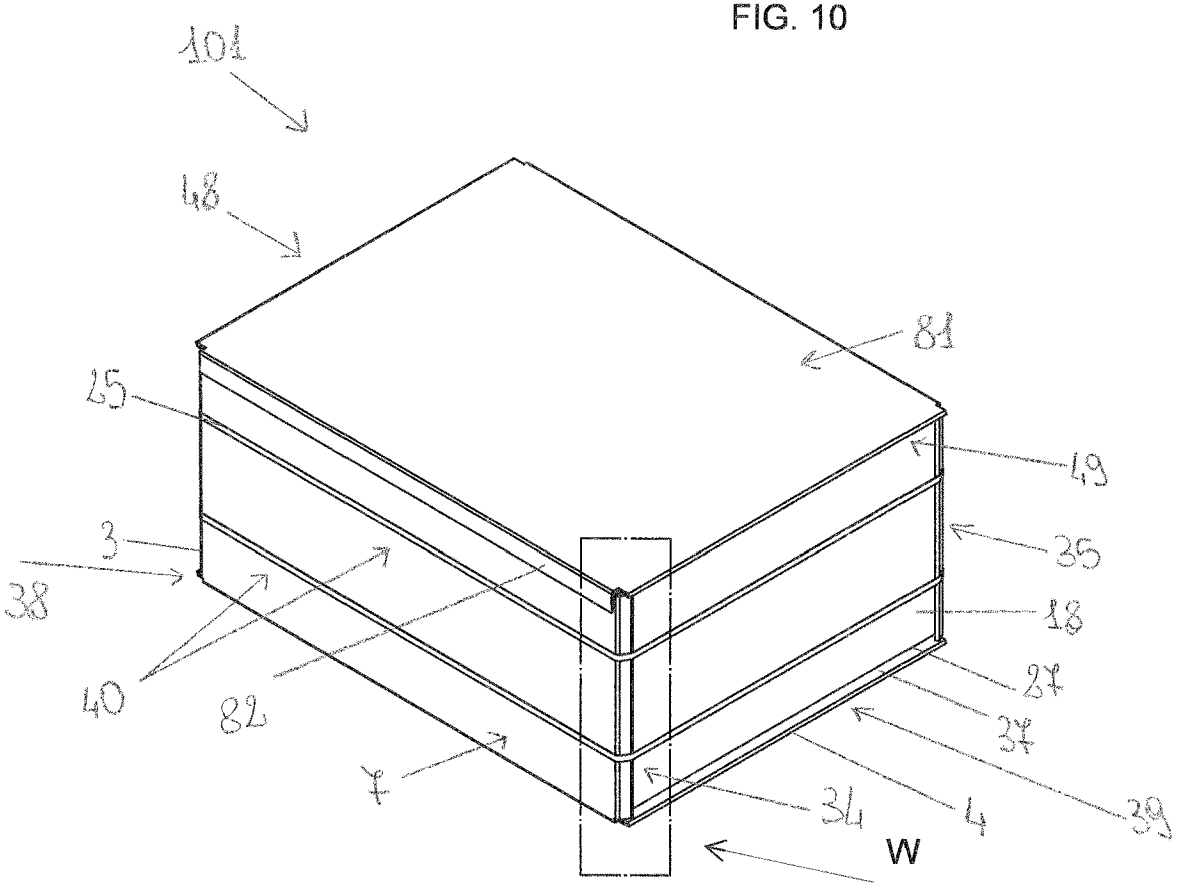
FIG. 10 is a perspective view illustrating a step of the method for realising a cardboard blank from a cardboard for packaging and for boxing at least an article with the cardboard blank, object of the present invention.
Figure 12:
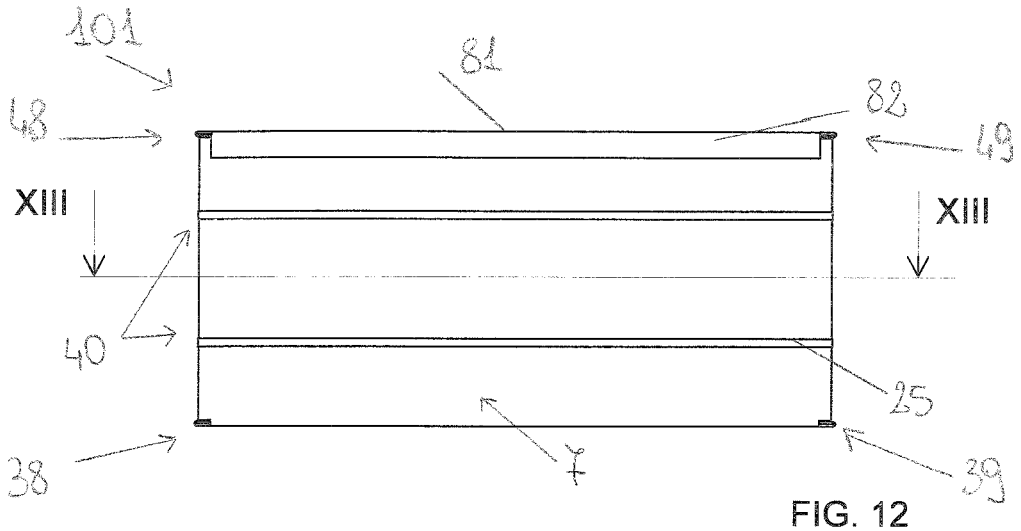
FIG. 12 is a lateral view of a box realised with the method of the present invention.
Figure 13:
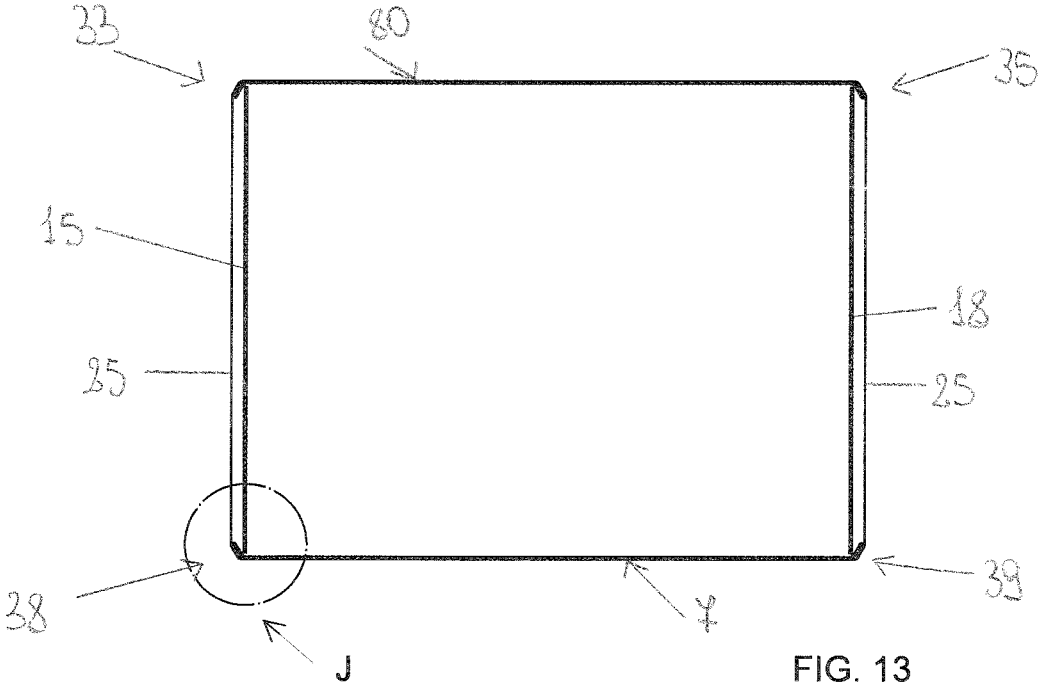
FIG. 13 is a sectioned in larger scale, along section XIII-XIII of FIG. 12.
Figure 14:
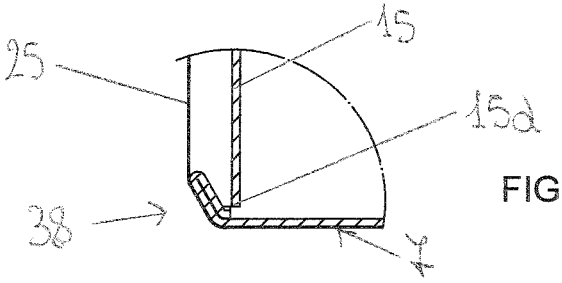
FIG. 14 is a view of detail J of FIG. 13.

With reference to FIGS. 6 and 7, the fifth portion (81) comprises a contact strip (82) which extends parallel to a free end (7*c*) of the second portion (7) and which entirely contacts the second portion (7) when the third portion (8) and the second portion (7) are folded and overlapped on one another.

In detail, the method of the present invention comprises further steps of: carrying out a seventh cut and an eighth cut each made in a transversal direction to the first score line (3) and to the second score line (4) so that a part of the fifth reinforcing flap (44) is removed and a part of the sixth reinforcing flap (45) is removed to laterally define the contact strip (82). Therefore the contact strip (82) can have a rectangular shape, in which the relative length coincides with the length of the external side of the fifth portion (81).

It is understood that the foregoing has been described by way of non-limiting example, so that any constructional variants are understood to fall within the scope of protection of the present technical solution, as claimed in the following.

The invention claimed is:

1. A method for realising a cardboard blank from a cardboard for packaging and for boxing at least one article with the cardboard blank, wherein the at least one article comprises a first flank, a second flank opposite the first flank, a third flank comprised between the first flank and the second flank, a fourth flank comprised between the first flank and the second flank and opposite the third flank, a bottom and an upper face opposite the bottom, comprising:

providing a cardboard for packaging which is flat;

making a first score line and a second score line on the cardboard for packaging, so that the first score line and the second score line are parallel to one another and so that the following are identified: a central sector comprised between the first score line and the second score line, comprising a first portion, a second portion and a third portion, the first portion being interposed between the second portion and the third portion; a first lateral sector comprised between the first score line and a first lateral end of the of the cardboard for packaging and a second lateral sector 11 comprised between the second score line and a second lateral end of the cardboard for packaging, which is opposite the first lateral end;

carrying out a first cut, a second cut, a third cut and a fourth cut each made in a transversal direction to the first score line and to the second score line so that: the first cut and the second cut are carried out on the first lateral sector and extend from the first lateral end of the cardboard for packaging to the first score line, so that a first closing flap is identified in the first lateral sector, foldable towards the first portion and having a first edge and a second edge opposite one another, a first reinforcing flap foldable towards the second portion and a second reinforcing flap foldable towards the third portion, the first closing flap being interposed between the first reinforcing flap and the second reinforcing flap; the third cut and the fourth cut are carried out on the second lateral sector and extend from the second lateral end of the cardboard for packaging to the second score line, so that a second closing flap is identified in the second lateral sector, foldable towards the first portion and having a third edge and a fourth edge opposite one another, a third reinforcing flap foldable towards the second portion and a fourth reinforcing flap foldable towards the third portion, the second closing flap being interposed between the third reinforcing flap and the fourth reinforcing flap;

if the dimensions of a box to be obtained exceed, by a predetermined value, the dimensions of the at least one article to be boxed, cutting the cardboard for packaging in order to reduce the dimensions of the box to be obtained;

if the cardboard for packaging is an integral part of a band of cardboard for packaging, cutting the cardboard for packaging so as to obtain a sheet of cardboard for packaging;

arranging the at least one article on the first portion so that the bottom of the at least one article is arranged resting on the first portion;

folding the first closing flap with respect to the first score line to cover at least the first flank of the at least one article;

folding the second closing flap with respect to the second score line to cover at least the second flank of the at least one article;

folding the second portion to cover at least the third flank of the at least one article with the consequence that the first reinforcing flap is projecting with respect to the first closing flap once the first closing flap has been folded and the third reinforcing flap is projecting with respect to the second closing flap once the second closing flap has been folded;

folding the third portion to cover at least the fourth flank and the upper face of the at least one article with the consequence that the second reinforcing flap is projecting with respect to the first closing flap once the first closing flap has been folded and the fourth reinforcing flap is projecting with respect to the second closing flap once the second closing flap has been folded; and tightening a strapping band about the second portion, the first reinforcing flap, the first closing flap, the second reinforcing flap, the third portion, the fourth reinforcing flap, the second closing flap and the third reinforcing flap, so as to cause: the folding of the first reinforcing flap towards the first closing flap with a consequent covering of the first edge of the first closing flap; the folding of the second reinforcing flap towards the first closing flap with a consequent covering of the second edge of the first closing flap; the folding of the third reinforcing flap towards the second closing flap with a consequent covering of the third edge of the second closing flap; the folding of the fourth reinforcing flap towards the second closing flap with a consequent covering of the fourth edge of the second closing flap.

2. The method for realising a cardboard blank from a cardboard for packaging and for boxing at least one article with the cardboard blank of claim 1, further comprising:

folding the first reinforcing flap towards the second portion with respect to the first score line so as to overlap the first reinforcing flap and the second portion with respect to one another in order to define a first overlapping area;

folding the second reinforcing flap towards the third portion with respect to the first score line so as to overlap the second reinforcing flap and the third portion with respect to one another in order to define a second overlapping area;

folding the third reinforcing flap towards the second portion with respect to the second score line so as to overlap the third reinforcing flap and the second portion with respect to one another in order to define a third overlapping area;

folding the fourth reinforcing flap towards the third portion with respect to the second score line so as to overlap the fourth reinforcing flap and the third portion with respect to one another in order to define a fourth overlapping area;

and wherein the step of folding the second portion includes folding the second portion with the consequence that a part of the first overlapping area is projecting with respect to the first closing flap once the first closing flap has been folded and a part of the third overlapping area is projecting with respect to the second closing flap once the second closing flap has been folded;

and wherein the step of folding the third portion includes folding the third portion with the consequence that a part of the second overlapping area is projecting with respect to the first closing flap once the first closing flap has been folded and a part of the fourth overlapping area is projecting with respect to the second closing flap once the second closing flap has been folded;

and wherein the step of tightening the strapping band is such as to cause: the folding of the projecting part of the first overlapping area towards the first closing flap with a consequent covering of the first edge of the first closing flap; the folding of the projecting part of the second overlapping area towards the first closing flap with a consequent covering of the second edge of the first closing flap; the folding of the projecting part of the third overlapping area towards the second closing flap with a consequent covering of the third edge of the second closing flap; the folding of the projecting part of the fourth overlapping area towards the second closing flap with a consequent covering of the fourth edge of the second closing flap.

3. The method for realising a cardboard blank from a cardboard for packaging and for boxing at least one article with the cardboard blank of claim 2, further comprising:

making a third score line on the first closing flap and a fourth score line on the second closing flap so that the first score line, the second score line, the third score line and the fourth score line are parallel to one another and wherein a first part of the first closing flap is defined, which is comprised between the first score line and the third score line and a second part of the second closing flap is defined, which is comprised between the second score line and the fourth score line;

and wherein the step of folding the first closing flap includes folding the first closing flap towards the first portion with respect to the first score line so as to overlap the first part of the first closing flap and the first portion so as to define a fifth overlapping area and further folding the first closing flap with respect to the third score line to cover at least the first flank of the at least one article;

and wherein the step of folding the second closing flap includes folding the second closing flap towards the first portion with respect to the second score line so as to overlap the second part of the second closing flap and the first portion so as to define a sixth overlapping area and further folding the second closing flap with respect to the fourth score line to cover at least the second flank of the at least one article.

4. The method for realising a cardboard blank from a cardboard for packaging and for boxing at least one article with the cardboard blank according to claim 1, wherein the step of tightening the strapping band comprises the step of tightening a plurality of strapping bands about the second portion, the first reinforcing flap, the first closing flap, the second reinforcing flap, the third portion, the fourth reinforcing flap, the second closing flap and the third reinforcing flap, which strapping bands of the plurality of strapping bands are arranged distanced from one another.

5. The method for realising a cardboard blank from a cardboard for packaging and for boxing at least one article with the cardboard blank according to claim 1, wherein the third portion comprises a fourth portion and a fifth portion, the fourth portion being interposed between the first portion and the fifth portion;

the second reinforcing flap is hinged to a first end of the fourth portion and is foldable against the fourth portion, the first end of the fourth portion being a part of a first end of the third portion;

the fourth reinforcing flap is hinged to a second end of the fourth portion and is foldable against the fourth portion, the second end of the fourth portion being a part of a second end of the third portion; and wherein the method comprises following steps:

carrying out a fifth cut and a sixth cut each made in a transversal direction to the first score line and to the second score line so that: the fifth cut is carried out on the first lateral sector and extends from the first lateral end of the cardboard for packaging to the first score line, so that a fifth reinforcing flap is identified in the first lateral sector, which fifth reinforcing flap is foldable towards the fifth portion and the sixth cut is carried out on the second lateral sector and extends from the second lateral end of the cardboard for packaging to the second score line, so that a sixth reinforcing flap is identified in the second lateral sector, which sixth reinforcing flap is foldable towards the fifth portion;

folding the fourth portion to cover at least the fourth flank of the at least one article;

folding the fifth portion to cover at least the upper face of the at least one article with the consequence that the fifth reinforcing flap is projecting with respect to the first closing flap once the first closing flap has been folded and the sixth reinforcing flap is projecting with respect to the second closing flap once the second closing flap has been folded.

6. The method for realising a cardboard blank from a cardboard for packaging and for boxing at least one article with the cardboard blank of claim 5, further comprising:

folding the fifth reinforcing flap towards the fifth portion with respect to the first score line so as to overlap the fifth reinforcing flap and the fifth portion with respect to one another in order to define a seventh overlapping area;

folding the sixth reinforcing flap towards the fifth portion with respect to the second score line so as to overlap the sixth reinforcing flap and the fifth portion with respect to one another in order to define an eighth overlapping area;

and wherein the step of folding the fifth portion includes folding the fifth portion with the consequence that a part of the seventh overlapping area is projecting with respect to the first closing flap once the first closing flap has been folded and a part of the eighth overlapping area is projecting with respect to the second closing flap after the second closing flap has been folded.

7. The method for realising a cardboard blank from a cardboard for packaging and for boxing at least one article with the cardboard blank of claim 5, wherein: the fifth portion comprises a contact strip which extends parallel to a free end of the second portion and which entirely contacts the second portion when the third portion and the second portion are folded and overlapped on one another.

* * * * *